US006914586B2

(12) United States Patent
Burkhardt

(10) Patent No.: US 6,914,586 B2
(45) Date of Patent: Jul. 5, 2005

(54) LCD MODULE IDENTIFICATION

(75) Inventor: Helmut Burkhardt, Heidelberg (DE)

(73) Assignee: Dialog Semiconductor GmbH, Kirchheim (DE)

( * ) Notice: Subject to any disclaimer, the term of this patent is extended or adjusted under 35 U.S.C. 154(b) by 312 days.

(21) Appl. No.: 10/100,753

(22) Filed: Mar. 19, 2002

(65) Prior Publication Data

US 2003/0169222 A1 Sep. 11, 2003

(30) Foreign Application Priority Data

Mar. 11, 2002 (EP) ..... 02368024

(51) Int. Cl.[7] ..... G09G 3/36
(52) U.S. Cl. ..... 345/87; 345/100; 345/102
(58) Field of Search ..... 345/87, 1, 3, 3.1, 345/132, 213, 768, 428, 100, 856, 868, 102, 76 Y; 710/268; 349/152; 324/765; 382/214; 379/142; 715/856; 370/395.64; 273/269

(56) References Cited

U.S. PATENT DOCUMENTS 4,747,600 A * 5/1988 Richardson ..... 463/19
4,914,689 A * 4/1990 Quade et al. ..... 379/142.01
5,825,341 A 10/1998 Pawlowski ..... 345/87
6,002,385 A * 12/1999 Silverbrook ..... 345/100
6,049,316 A * 4/2000 Nolan et al. ..... 345/698
6,219,451 B1 * 4/2001 Hunt et al. ..... 382/214
6,222,518 B1 4/2001 Ikeda et al. ..... 345/98
6,262,594 B1 7/2001 Cheung et al. ..... 326/38
6,300,921 B1 10/2001 Moriconi et al. ..... 345/30
6,323,930 B1 * 11/2001 Higuchi et al. ..... 349/152
6,344,754 B1 * 2/2002 Tamai ..... 324/765
6,538,675 B2 * 3/2003 Aratani et al. ..... 715/856
6,559,826 B1 * 5/2003 Mendelson et al. ..... 345/102
6,600,747 B1 * 7/2003 Sauber ..... 370/395.64
6,665,761 B1 * 12/2003 Svenkeson et al. ..... 710/268

FOREIGN PATENT DOCUMENTS

EP 0419910 A2 3/1991 ..... G06F/3/14

* cited by examiner

*Primary Examiner*—Amare Mengistu
*Assistant Examiner*—Prabodh Dharia
(74) *Attorney, Agent, or Firm*—George O. Saile; Stephen B. Aukerman

(57) ABSTRACT

A circuit and a method for an effective way to customize the display driver software of any type of LCD-display and any type of LCD-driver chip used in an LCD display system is achieved. This is important in a multiple sourcing environment where LCD driver chips and LCD modules from different vendors are used in LCD display systems. This is accomplished through identification and registration of the information relevant for the said software customization by storing said information in an LCD module identification register. A microprocessor controlling the LCD display system is reading this identification register and providing the software customization elements specific to the LCD-driver chip and to the LCD-module during an initialization step of the system.

32 Claims, 2 Drawing Sheets

LCD MODULE IDENTIFICATION

BACKGROUND OF THE INVENTION (1) Field of the Invention

The invention relates to liquid crystal display (LCDs) systems, comprising a microprocessor unit (MPU) and an LCD module comprising an LCD display and an LCD driver chip, and more particularly, to a circuit and a method to identify and to register in said LCD system information the physical characteristics of said LCD module and said LCD driver chip to provide an easy way to configure and customize the system software for said LCD driver chip and said LCD module.

(2) Description of the Prior Art

Every LCD module type and LCD driver chip type needs it own specific display driver software to be adapted to the specific requirements and parameters as specific memory organization, control register setting, number of characters per line required, contrast tables, etc. of specific LCD drivers. The system software of LCD display systems has to be configured according to the specific types of LCD-driver chips and LCD modules used. This situation makes multiple sourcing for LCD modules and LCD driver chips difficult, the system software required has to be adopted for each type of driver chip and LCD module used individually. Said specific adoption is a critical step in the manufacturing process.

In prior art multiple sourcing of LCD modules and LCD driver chips is often avoided to circumvent the handling problems linked with the requirement of customizing the driver software for every type of LCD modules and LCD driver chips used in the system with the disadvantage of not using the components available on the market at the best pricing conditions. Otherwise in prior art these multiple source components are being used on the expense of a significant handling effort for the complex customizing of the software, especially it has to be absolutely assured that the right software version is adopted to the specific type of LCD-driver chips and LCD-modules used in the LCD system.

Several prior art inventions describe the deployment of LCD-modules and LCD-driver chips. U.S. Pat. No. 5,825,341 to Pawlowski shows a control interface for a liquid crystal display having more than 80 characters using a pair of controller/driver devices. The usage of one or two standard controller/drivers of the same kind is recommended. U.S. Pat. No. 6,222,518 B1 to Ikeda et al. describes a data processing system including a bus and a display data generating circuit coupled to the bus for generating display data and a display apparatus coupled to the bus. U.S. Pat. No. 6,262,594 B1 to Cheung et al. discloses an integrated circuit chip having pads that are grouped into a number of groups and also having functional modules that share use of two or more groups of the pads for transferring signals to or from external circuitry.

SUMMARY OF THE INVENTION

A principal object of the present invention is to provide a method and a circuit for an easy handling of the LCD system software customization process regarding the specific requirements of specific types of LCD modules and LCD driver chips used as part of an LCD system.

A further object of the present invention is to provide a circuit in the LCD-display system to register and contain the information required for the identification of the specific LCD-module types and LCD-driver chip types used in an LCD system.

A still further object of the present invention is to implement an effective method of the adoption of the required system software version to drive the specific LCD module types and the specific LCD chip types used in an LCD display system.

In accordance with the objects of this invention an identification system for an LCD system comprising an LCD module and a microprocessor unit to control said LCD system is achieved. Said LCD module includes an LCD driver chip and an LCD display. An LCD information register is located within said LCD system for holding information required to identify the physical characteristics of said LCD driver chip and said LCD display. Means for providing said information to said microprocessor unit to customize the system software of said LCD module to the specific requirements of the said LCD driver chip and said LCD display are introduced.

In accordance with the objects of this invention an identification system for an LCD system comprising an LCD module and a microprocessor unit to control said LCD system is achieved. Said LCD module includes an LCD driver chip and an LCD display. An LCD information register is located within said LCD system for holding information required to identify the physical characteristics of said LCD driver chip and said LCD display. Any serial or parallel interface using any communications protocol can be used to provide said information to said microprocessor unit to customize the system software of said LCD module to the specific requirements of the said LCD driver chip and said LCD display.

In accordance to further objects of the invention a method for the customization of a system software that drives an LCD module in an LCD system is achieved. Said system includes said LCD module, a microprocessor unit, an LCD identification register, and wherein said LCD module includes an LCD driver chip and an LCD display. Information about the physical characteristics of said LCD driver chip and said LCD module is provided to said LCD identification register. Said information is inputted from said register into said microprocessor unit. The specific parameters required for the specific types of LCD driver chip and said LCD display are selected and assigned according to said information read from the said identification register by said microprocessor unit. Said parameters are supplied by said microprocessor unit to said LCD driver chip and said LCD module for said customization of said system software.

In accordance to further objects of the invention a method for the customization of a system software that drives an LCD module in an LCD system is achieved. Said system includes said LCD module, a microprocessor unit, an LCD identification register, and wherein said LCD module includes an LCD driver chip and an LCD display. Information about the physical characteristics of said LCD driver chip and said LCD module is provided to said LCD identification register wherein said physical characteristics contain information such as the manufacturer of the LCD-driver chip, the type of the LCD-driver chip, the version of the LCD driver chip, the manufacturer of the LCD-module, the type of the LCD-module, the version of the LCD-module and other relevant information. Said information is inputted from said register into said microprocessor unit. The specific parameters required for the specific types of LCD driver chip and said LCD display are selected and assigned according to said information read from the said identification register by said microprocessor unit. Said parameters are supplied by said microprocessor unit to said LCD driver chip and said LCD module for said customization of said system software.

BRIEF DESCRIPTION OF THE DRAWINGS

In the accompanying drawings forming a material part of this description, there is shown.

DESCRIPTION OF THE PREFERRED EMBODIMENTS

The preferred embodiments disclose a novel method and circuits for the adoption of the software to drive a liquid crystal display (LCD) system to the specific requirements of any types of LCD driver chips and any types of LCD modules, functionally suitable for the requirements of said LOD system. This is very important for LCD systems wherein the LCD driver chips and LCD modules are coming from multiple suppliers, therefore being of different types and versions of said components and having different software requirements caused by e.g. different memory organizations and/or different control register settings. Every LCD module type and LCD driver chip needs its specific software display driver. The software to control LCD systems has to be configured for the individual types and versions of the LCD driver chip and the LCD module used. Using LCD module identification and registration as part of the total LCD system makes the system software customization for different driver chips types and different LCD modules types used in an LCD system much easier and therefore enables the manufacturer of said LCD system to buy the best offer for said components available on the market from multiple sources.

Figure 1:
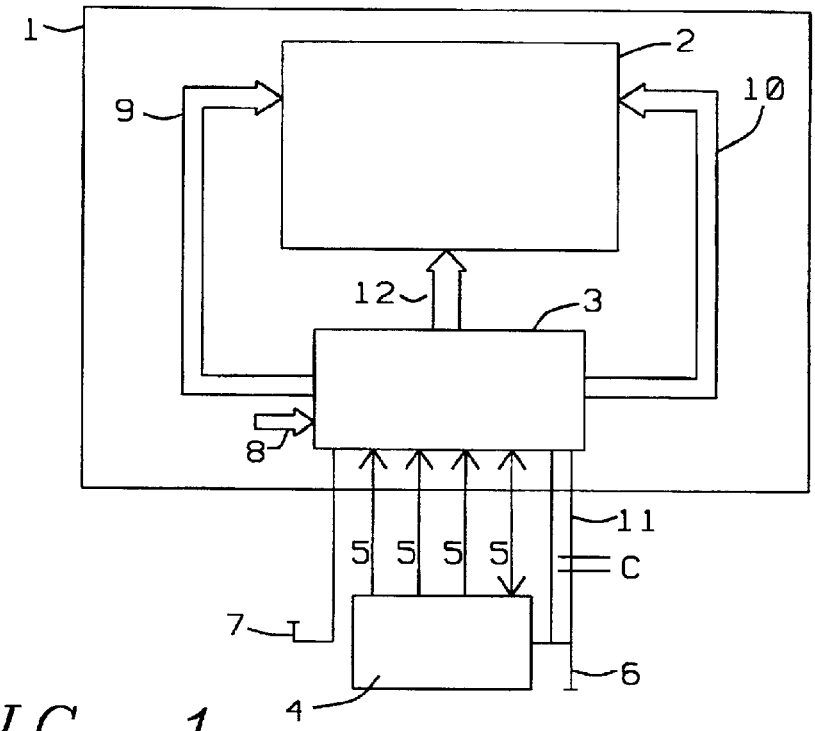
FIG. 1 illustrates an LCD display system comprising an LCD-module, an LCD-driver chip, a microprocessor unit (MPU) with memory and an interface to an LCD driver chip.

LCD displays are used in many different types of electronic consumer products such as mobile phones, organizers, navigation systems, etc. A typical LCD system is shown in FIG. 1. The LCD system is comprising an LCD module 1 and a microprocessor unit (MPU) 4. The LCD module is comprising an LCD display 2 and an LCD driver chip 3. The MPU 4 communicates with the LCD driver via a serial interface lines 5. VSS lines 6 and VDD lines 7 are providing the power supply for the LCD driver chip and the LCD display. A capacitor C stabilizes the high LCD driving voltage VLCD 11 generated by the LCD driver chip. The LCD driver chip 3 is driving rows 9, 10 and the columns 12 of the LCD display 2. The LCD module identification register 8 is located within the LCD driver chip 3. As example of an existing embodiment the MPU is mounted on a printed circuit, the LCD driver chip is mounted on the glass (COG) of the LCD module.

One key element of the invention is to keep the information about the specific types and characteristics of the LCD modules and the driver chips used in an LCD system in an LCD module identification register within said LCD system. Every type of an LCD driver chip and every type of an LCD display needs a specific parameter setting for the LCD system software as e.g. characters per line, brightness, contrast table etc. These parameters differ from the type of LCD modules and type of LCD driver chips used. Said LCD module identification register can be realized preferably on the LCD driver chip. Said identification register is being used to store information about the type of LCD driver chip and the type of LCD display used as part of said LCD system. Said LCD module identification register can be read by the MPU controlling the LCD system via the existing communication interface without increasing the number of signal connections from MPU to the LCD module.

The LCD module identification register can contain information for example about the manufacturer of the LCD driver chip, the type of the LCD driver chip, the version of the LCD driver chip, the manufacturer of the LCD module, the type of the LCD module, the version of the LCD module, etc.

There are various ways to supply said LCD module identification information to the LCD identification register. One simple and low cost approach is to supply the information about the LCD module used via identification (ID) pads on the LCD driver chip and the information about the LCD driver chip to said chip by using either mask programmable registers or fuse programmable registers or re-programmable registers such as e.g. $E^2$PROM or other programming tools to be hold in the memory of said driver chip. Any of the information about the types of both said driver chip and said LCD module can be programmed inside the LCD driver chip using said one-time programmable or re-programmable registers. The supply of said information can be performed for instance during final test of the LCD system as an initialization step of said system. If one time programmable or programmable registers are used, the information about the LCD module can also be programmed into the driver chip at final test.

The information about the physical characteristics of the LCD modules can be supplied to ID pads by connections to either VDD tracks or VSS pads routed below the chip. Said supply is normally performed during the production process of the LCD module. The identification pads (ID) pads can be placed at any location required on the LCD driver chip. LCD driver chips for chips on glass (COG) applications in general have a high number of supply pads. Some of these supply pads can be used for LCD module identification without increasing the number of pads required. Replacing some of the VSS and/or VDD supply pads by ID pads in between the other VSS and VDD supply pads will not increase the track resistance of the supplies significantly and allows an easy way to supply the configuration information to the LCD module information register.

Depending on the way said identification information is supplied and stored said LCD identification register is implemented in one or two different ways. In case the identification information for both LCD module and LCD driver chip is supplied by one-time programmable or re-programmable registers said LCD identification register resides in the memory of said LCD driver chip. In case parts of said identification information are supplied to the ID pads and parts of said information is supplied by said programmable registers the LCD identification register will be divided in 2 parts, one part is in the register and the other part is hard coded on the ID pads of the driver chip.

Figure 2:
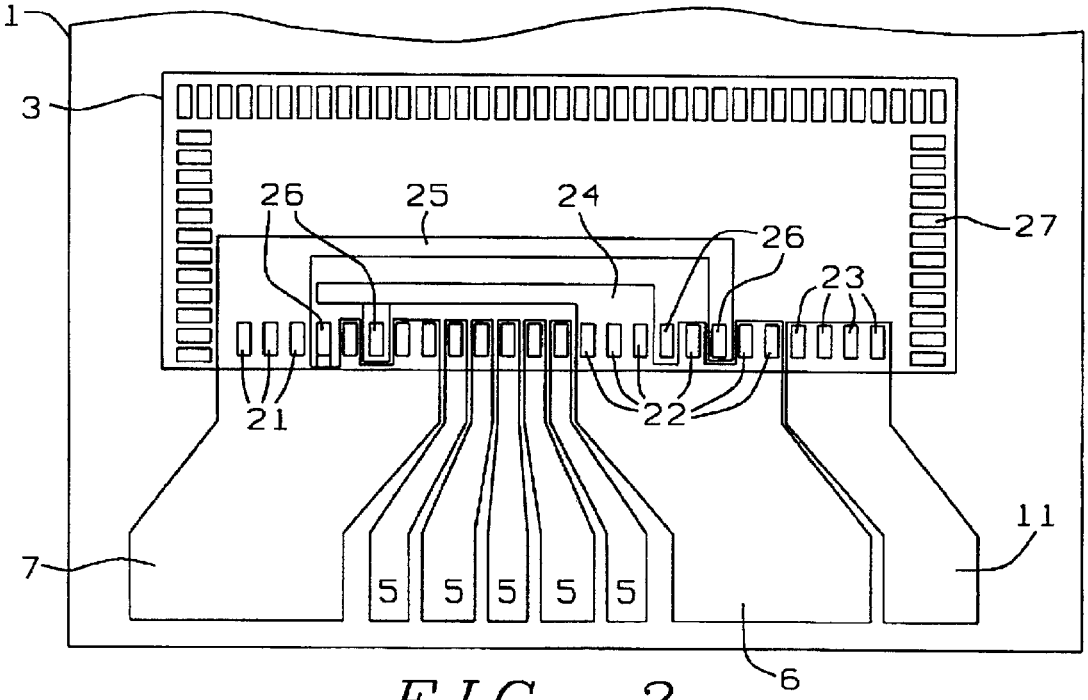
FIG. 2 illustrates an example of an LCD-driver module with an LCD-driver chip including an LCD-system identification register and the placement of the configuration pads for an advantageous routing of VSS and VDD tracks.

FIG. 2 shows an example for the layout of an LCD module 1 with an LCD driver chip 3 and the placement of the identification (ID) pads (ID0 . . . IDn) 26 used for the module identification. The same numbers for the main components used in FIG. 1 are used in FIG. 2 as well. The signal tracks to the LCD display are omitted. VDD 6 and VSS 7 are the power supply voltages for the LCD module. A few of the VSS pads 21 and VDD pads 22 are shown. The VSS 24 and VDD tracks 25 used to set the ID information are routed below the LCD driver chip (VSS and VDD track routing). The VSS track 25 below the LCD driver chip is beginning at the VSS pads 21 located left of the ID pads 26 and ends at the right sight of the LCD driver chip. The VDD track 24 is beginning at the left side of the VDD pads 22 and ends at the left side of the LCD driver chip. Using a configuration like this the ID pads 26 can be either connected to VDD or VSS and are able to be used as a configurable LCD module ID. In reality there will be more ID pads 26 used than shown on the drawing. The number of ID pads depends on the volume of information to be held in the LCD module identification register. The number of supply pads is sufficient to spare some of them as identification pads. The driver chip is surrounded segment driver pads 27 used for driving the segments of the display. Changing the ID information can be done by low effort changing the glass layout, just by modifying the configurable LCD module tracks.

Figure 3:
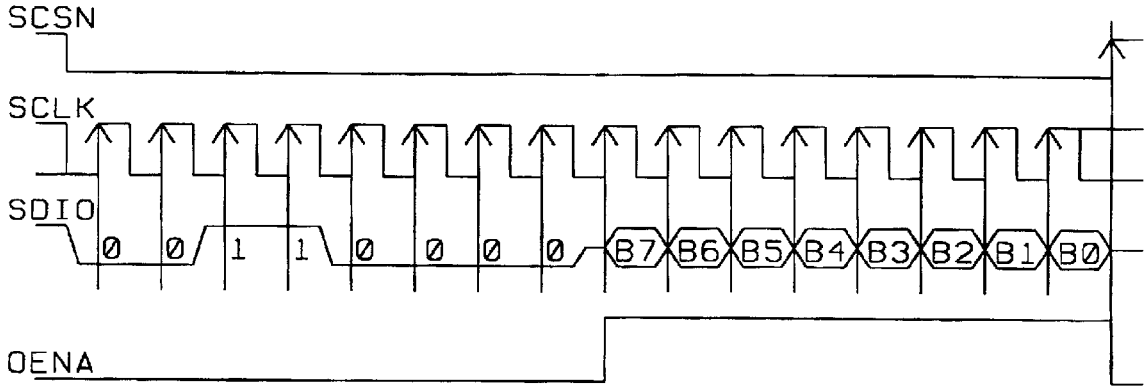
FIG. 3 illustrates an example for a serial communication protocol to read out the LCD-module identification.

The LCD module identification register can be read via any serial or parallel interface using any communication protocol. An example for a serial communication protocol is shown in FIG. 3. This example shows a serial communication protocol to read out the LCD module identification register. The instruction sent by the MPU to read the said identification register on the driver chip is "00110000". The Identification code sent back is B[7:0]. The signal called OENA represents the driver chip internal control signal for bi-directional SDIO.

The MPU has its own memory where the system software and related parameters of required types of driver chips and the LCD displays to operate the LCD system are stored. In an initialization step, for instance during the power up sequence the MPU can read the LCD module identification register and can then assign and load the specific software and the parameters required to the LCD driver chip.

It is obvious that this invention applies also for the case where more than one driver chips are used in an LCD system. In case all driver chips are identical it is sufficient to keep said LCD module identification register on one of the LCD driver chips used. In case the LCD driver chips have different physical characteristics, e.g. different types of LCD driver chips are driving the LCD rows and columns, said LCD module identification register has to be implemented on each LCD driver chip. In this case the MPU will read from each LCD driver chip said identification register and will supply the specific parameters to each of said LCD driver chips individually.

Figure 4:
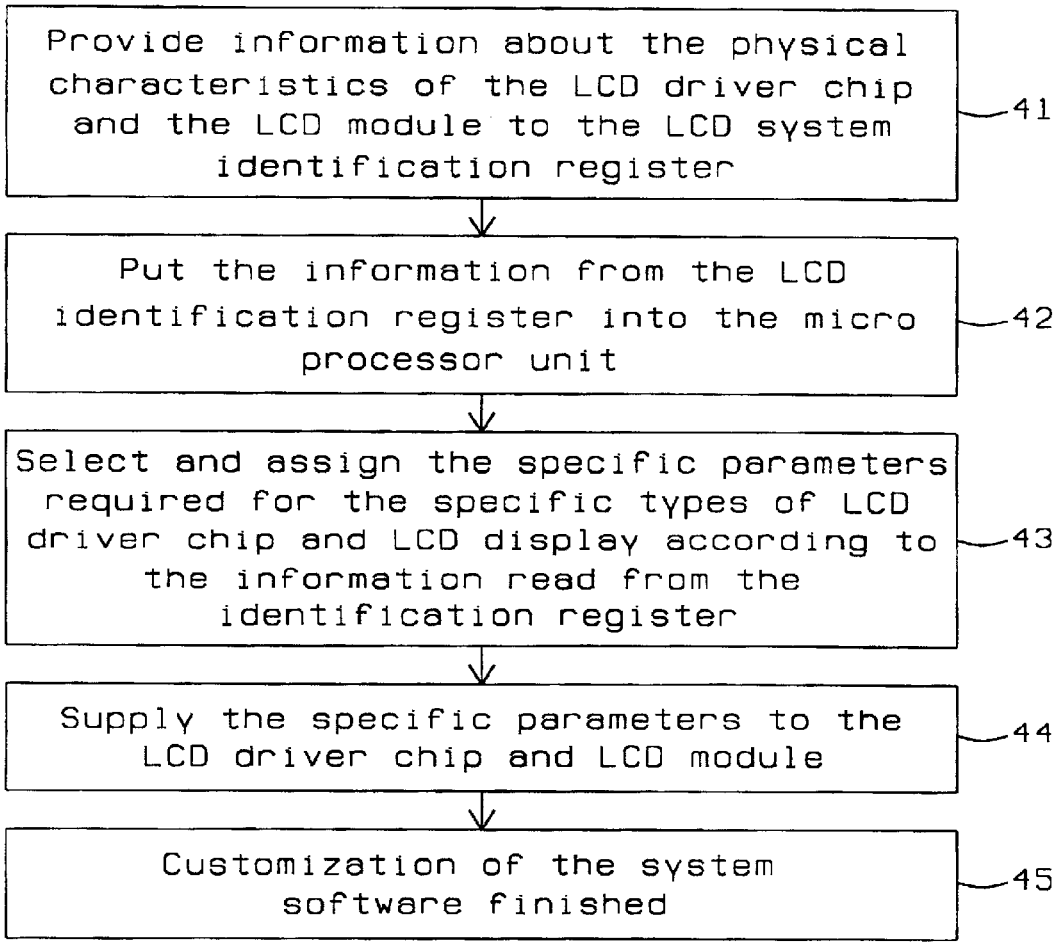
FIG. 4 illustrates a method of the customization of the driver software of the LCD-module and the LCD-driver chip.

FIG. 4 illustrates a method how the LCD module identification register is used for the customization of the system software of the LCD display system. In step 41, performed during the production/test of the driver/module), the information about the physical characteristics as type, manufacturer and version of the LCD driver chip and the LCD module used in the LCD display system is provided to the LCD module identification register. In step 42 a microprocessor is reading said information supplied to the said identification register before. In step 43 said microprocessor selects and assigns the parameters required for the specific LCD driver chip and for the LCD display used in the LCD system according to the result of the readout of step 42. For instance the selected parameters could cover items as the number of characters per line, brightness, contrast table, etc. In step 44 the microprocessor supplies said selected parameters to the LCD driver chip and to the LCD display. Step 45 closes this initialization method of the system software.

While the invention has been particularly shown and described with reference to the preferred embodiments thereof, it will be understood by those skilled in the art that various changes in form and details may be made without departing from the spirit and scope of the invention.

What is claimed is:

1. An identification system for an LCD system comprising:

an LCD module comprising at least one LCD driver chip and an LCD display;

a microprocessor unit to control said LCD system;

an LCD identification register located within one of said LCD driver chips for holding information required to identify the physical characteristics of said LCD driver chip and said LCD display wherein at least parts of the information stored in said LCD identification register are supplied to said register via programmable registers; and means for providing said information to said microprocessor unit to customize the system software of said LCD module to the specific requirements of the said LCD driver chip and said LCD display.

2. The system of claim 1 wherein more than one driver chips are used to control the LCD module, wherein all driver chips are identical and wherein said LCD identification register is kept only on one of said driver chips.

3. The system of claim 1 wherein said LCD module identification register is containing all information required to select the parameters required for the customization of the system software of said LCD system such as the manufacturer of the LCD-driver chip;

the type of the LCD-driver chip;

the version of the LCD driver chip;

the manufacturer of the LCD-module;

the type of the LCD-module;

the version of the LCD-module; and other relevant information, wherein said information is put into said identification register by means of information supply.

4. The system of claim 1 wherein parts of the information or all of the information stored in the LCD module identification system are supplied to said identification register via mask programmable registers.

5. The system of claim 1 wherein parts of the information or all of the information stored in the LCD module identification system are supplied to said identification register via fuse programmable registers.

6. The system of claim 1 wherein parts of the information or all of the information stored in the LCD module identification system are supplied to said identification register via re-programmable registers such as $E^2$PROM or other re-programmable registers.

7. The system of claim 1 wherein parts of the information or all of the information stored in the LCD module identification register are supplied via identification pads on the LCD driver chips.

8. The system of claim 7 wherein said identification pads are using the locations of some VSS or VDD supply pads.

9. The system of claim 7 wherein the supply tracks for identification information supply are routed below the driver chip.

10. An identification system for an LCD system comprising:

an LCD module, wherein said LCD module includes at least one LCD driver chips and an LCD display;

a microprocessor unit to control said LCD system;

an LCD information register located within one of said LCD driver chips for holding information required to identify the physical characteristics of said LCD driver chip and said LCD display, wherein parts of the information or all of the information stored in said LCD identification register are supplied to said register via programmable registers; and any serial or parallel interface using any communications protocol for providing said information to said microprocessor unit to customize the system software of said LCD module to the specific requirements of the said LCD driver chip and said LCD display.

11. The system of claim 10 wherein more than one driver chip is used to control the LCD module, wherein all driver chips are identical and wherein said LCD identification register is kept only on one of said driver chips.

12. The system of claim 10 wherein said LCD module identification register is containing all information required to select the parameters required for the customization of the system software of said LCD system such as the manufacturer of the LCD-driver chip;

the type of the LCD-driver chip;

the version of the LCD driver chip;

the manufacturer of the LCD-module;

the type of the LCD-module;

the version of the LCD-module; and other relevant information;

wherein said information is put into said identification register by means of information supply.

13. The system of claim 12 wherein parts of the information or all of the information stored in the LCD module identification system are supplied to said identification register via mask programmable registers.

14. The system of claim 12 wherein parts of the information or all of the information stored in the LCD module identification system are supplied to said identification register via fuse programmable registers.

15. The system of claim 12 wherein parts of the information or all of the information stored in the LCD module identification system are supplied to said identification register via re-programmable registers such as $E^2$PROM or other re-programmable registers.

16. The system of claim 12 wherein parts of the information or all of the information stored in the LCD module identification register are supplied via identification pads on the LCD driver chips.

17. The system of claim 16 wherein said identification pads are using the locations of some VSS or VDD supply pads.

18. The system of claim 16 wherein the supply tracks for identification information supply are routed below the driver chip.

19. The method for the customization of a system software that drives an LCD module in an LCD system which system includes said LCD module, a microprocessor unit, an LCD identification register, and wherein said LCD module includes an LCD driver chip and an LCD display comprising:

providing information about the physical characteristics of said LCD driver chip and said LCD module to said LCD identification register wherein said physical characteristics contain information such as the manufacturer of the LCD-driver chip, the type of the LCD-driver chip, the version of the LCD driver chip, the manufacturer of the LCD-module, the type of the LCD-module, the version of the LCD-module and other relevant information;

inputting from said register said information into said microprocessor unit;

selecting and assigning the specific parameters required for the specific types of LCD driver chip and said LCD display according to said information read from the said identification register by said microprocessor unit; and supplying by said microprocessor unit said parameters to said LCD driver chip and said LCD module for said customization of said system software.

20. The method of claim 19 wherein said means of information supply is performed partly from outside using configuration pads of the LCD-driver chip and partly performed by programming inside the LCD driver by using any programmable registers.

21. The method of claim 19 wherein said means of information supply is performed by programming inside the LCD-driver chip using mask programmable registers.

22. The method of claim 19 wherein said means of information supply is performed by programming inside the LCD-driver chip using fuse programmable registers.

23. The method of claim 19 wherein said means of information supply is performed by programming inside the LCD-driver chip using re-programmable registers such as $E_2$PROM or others.

24. The method of claim 19 wherein the microprocessor keeps in a database all parameters required for the system software customization of all LCD driver chips and LCD displays, which might be used for an LCD display system, to be loaded to the LCD module in an initialization step.

25. An identification system for an LCD system comprising an LCD module wherein said LCD module includes more than one driver chip, wherein said driver chips have different physical characteristics, and an LCD display;

a microprocessor unit to control said LCD system;

an LCD information register, being located on each of said LCD driver chips, for holding information required to identify the physical characteristics of its LCD driver chip and said or all of the information stored in said LCD identification register are supply to said register via programmable registers; and any serial or parallel interface using any communications protocol for providing said information to said microprocessor unit to customize the system software of said LCD module to the specific requirements of said LCD driver chip and said LCD display.

26. The system of claim 25 wherein said LCD module identification register is containing all information required to select the parameters required for the customization of the system software of said LCD system such as the manufacturer of the LCD-driver chip;

the type of the LCD-driver chip;

the version of the LCD driver chip;

the manufacturer of the LCD-module;

the type of the LCD-module;

the version of the LCD-module; and other relevant information;

wherein said information is put into said identification register by means of information supply.

27. The system of claim 25 wherein parts of the information or all of the information stored in the LCD module identification system are supplied to said identification register via mask programmable registers.

28. The system of claim 25 wherein parts of the information or all of the information stored in the LCD module identification system are supplied to said identification register via fuse programmable registers.

29. The system of claim 25 wherein parts of the information or all of the information stored in the LCD module identification system are supplied to said identification register via re-programmable registers such as $E^2$PROM or other re-programmable registers.

30. The system of claim 25 wherein parts of the information or all of the information stored in the LCD module identification register are supplied via identification pads on the LCD driver chips.

31. The system of claim 30 wherein said identification pads are using the locations of some VSS or VDD supply pads.

32. The system of claim 30 wherein the supply tracks for identification information supply are routed below the driver chip.

* * * * *